United States Patent [19]

Kydd

[11] Patent Number: 4,470,900

[45] Date of Patent: Sep. 11, 1984

[54] SOLIDS PRECIPITATION AND POLYMERIZATION OF ASPHALTENES IN COAL-DERIVED LIQUIDS

[75] Inventor: Paul H. Kydd, Lawrenceville, N.J.

[73] Assignee: HRI, Inc., Gibbsboro, N.J.

[21] Appl. No.: 148,876

[22] Filed: May 12, 1980

Related U.S. Application Data

[63] Continuation-in-part of Ser. No. 956,390, Oct. 31, 1978, abandoned.

[51] Int. Cl.[3] ..... C10G 1/00; B01D 21/00

[52] U.S. Cl. ..... 208/177; 208/8 LE; 208/10

[58] Field of Search ..... 208/8 LE, 10, 177

[56] References Cited

U.S. PATENT DOCUMENTS

| | | | |
|---|---|---|---|
| 3,519,554 | 7/1970 | Stotler | 208/10 |
| 3,791,956 | 2/1974 | Gorin et al. | 208/8 |
| 3,856,675 | 12/1974 | Sze et al. | 210/73 |
| 3,954,595 | 5/1976 | Sze et al. | 208/8 |
| 3,974,073 | 10/1976 | Sze et al. | 210/73 R |
| 4,028,221 | 6/1977 | Sze et al. | 208/8 |
| 4,040,958 | 8/1977 | Rammler | 210/73 R |
| 4,090,957 | 5/1978 | Leonard | 210/54 |

*Primary Examiner*—G. L. Kaplan
*Assistant Examiner*—W. T. Leader
*Attorney, Agent, or Firm*—Vincent A. Mallare

[57] ABSTRACT

The precipitation and removal of particulate solids from coal-derived liquids by adding a process-derived anti-solvent liquid fraction and continuing the precipitation process at a temperature above the melting point of the mixed liquids for sufficient time to allow the asphaltenes to polymerize and solids to settle at atmospheric pressure conditions. The resulting clarified light hydrocarbon overflow liquid contains less than about 0.02 W % ash and is suitable as turbine fuel or as boiler fuel for burning without particulate emission control equipment. An underflow liquid fraction containing less than about 0.1 W % solids along with low sulfur and nitrogen concentrations is suitable as a boiler fuel with emission control equipment.

16 Claims, 2 Drawing Figures

SOLIDS PRECIPITATION AND POLYMERIZATION OF ASPHALTENES IN COAL-DERIVED LIQUIDS

REFERENCE TO RELATED APPLICATION This present application is a continuation-in-part of co-pending application Ser. No. 956,390, filed Oct. 31, 1978, now abandoned.

BACKGROUND OF THE INVENTION

This invention pertains to the processing of coal-derived liquids to remove ash and unconverted coal particulate solids. It pertains particularly to solids removal steps utilizing the continued precipitation and settling of such solids to produce liquid products having very low solids concentrations, by using a selected self-derived anti-solvent fraction at substantially ambient pressure.

It is known that gas turbines can burn residual oils but cannot tolerate ash contents in the oil greater than a few hundred parts per million, or alkali metal contents greater than a few parts per million. Also, sulfur in turbine fuel oils must be low enough to be within legal restrictions, and fuel bound nitrogen is a more serious problem than it is for boilers. Even for boilers the new source performance standard now require fuel ash contents below 0.03% for burning without electrostatic precipitation or bag filters for removing particulates for flue gases. Because the residual hydrocarbon material containing ash from coal liquefaction processes, such as the H-Coal ® liquefaction process, is a low value product and because producing residual oil product consumes less hydrogen than producing distillates, there are strong economic incentives for upgrading such coal-derived residual oils to usable fuels by removing ash and the sulfur bound up in the ash to low concentrations.

Processes for removal of particulate solids from coal-derived liquids by the addition of a promotor or selected anti-solvent liquid to the coal-derived liquid stream containing unconverted coal and ash solids to produce precipitation and removal of such particulate solids have been previously disclosed in various patents. For example, U.S. Pat. No. 3,790,467 to Fiocco et al discloses a coal liquefaction process wherein solids are removed by precipitation from coal extract liquid by adding a solvent liquid which has been further hydrogenated. Similarly, U.S. Pat. No. 3,791,956 to Gorin et al discloses a coal liquefaction process in which a precipitating solvent which is an aliphatic or naphthenic hydrocarbon solvent having 75°–200° C. boiling range such as cyclo-hexane, n-decan, decalin, etc., is added to a stirred agglomeration zone which is maintained at 250°–370° C. temperature and 5–200 psig pressure. Such solvent liquid fractions do not normally occur in the liquid leaving Gorin's coal liquefaction zone, but may be recovered following subsequent hydrocracking steps, and produces a benzene-insoluble precipitated material. U.S. Pat. Nos. 3,852,182 and 3,856,675 to Sze et al disclose coal liquefaction processes wherein a promotor liquid having a characterization factor K of 9.75–11.0 is used to enhance solids precipitation and separation from a coal extract liquid. Furthermore, the K factor of the promotor liquid is at least 0.25 units higher than that of the liquefaction solvent. However, these processes require several processing steps and usually require the use of a petroleum-derived promotor liquid which must be recovered in high yield and in relatively pure form. They also require expensive pressurized settler vessels to achieve satisfactory solids removal from product liquid streams. An example of such settler vessel is disclosed in U.S. Pat. No. 3,962,008 to Sze. Also, U.S. Pat. No. 3,954,595 to Sze et al shows solids precipitation process for coal-derived liquid in which two gravity settlers in series are used for the removal of coal solids, and the overflow stream from each settler are joined together and passed to a recovery step.

Because of these problems, the use of more effective anti-solvent liquid fractions, which can be conveniently derived from the coal liquefaction process itself and which require simpler processing steps, have been sought.

Co-pending patent application Ser. No. 956,533, now abandoned by W. Volk et al discloses a process for solids precipitation from coal-derived liquids using an H-Coal ® process naphtha fraction as an anti-solvent or precipitating agent to reduce the ash content of the process hydroclone underflow liquid to a concentration previously acceptable for boiler fuel (0.1% by weight). However, even lower concentrations of ash and sulfur in product liquids are desired, particularly for use as turbine fuels, as well as substantial removal of sulfur and nitrogen usually contained in the asphaltenes.

SUMMARY OF THE INVENTION

It has been unexpectedly found that when hydrocarbon liquid product streams containing a selected precipitation anti-solvent liquid and residual ash and unconverted coal solids concentration are maintained in the liquid state at essentially atmospheric pressure, the solids continue to precipitate so that the resulting overflow product liquid portion contains very low ash solids, such as less than about 0.02 W % ash and preferably less than about 0.01 W % ash. An hypotheses for what occurs is that the anti-solvent liquid precipitation action which commenced with the mixed hydrocarbon liquid materials in a first settler step or vessel does not cease when the mixed material leaves the settler, but continues by the further polymerization of asphaltenes and precipitation of high molecular weight hydrocarbons and associated solids at atmospheric pressure as long as the material is substantially in liquid or molten condition. This further precipitation and settling achieves increased removal of solids and associated sulfur and nitrogen compounds from the overflow liquid fraction to produce desirable liquid products.

Accordingly, this invention describes an improved solids precipitation process in which coal-derived liquid containing increased residual oil and ash concentration from a centrifugal type liquid-solids separation step, such as a hydroclone or centrifuge, is mixed with a process-derived anti-solvent liquid fraction. The mixture is maintained at a sufficient temperature to keep it in a substantially liquid state, e.g. from near ambient temperature to about 400° F., for a sufficient time to permit polymerization of asphaltenes, further settling of solids and consequent purification of the overflow liquid product to the desired low solids specification at substantially atmospheric pressure. The overflow liquid from a first settler step can be passed to a second settler step for further solids settling and removal. The composition of liquid feed to the second settler step is such that it contains at least some of the coal-derived naphtha fraction as the precipitation or anti-solvent agent. There will usually be a gap in the boiling point range between the heavy, high boiling coal-derived liquid material being treated and the light, lower boiling anti-solvent material added. The anti-solvent material should have a normal boiling range between about 300°–550° F., and is derived solely from the coal liquefaction process. It is not an extraneous petroleum-derived solvent or promotor material as used in other solvent deashing processes.

This solids settling process provides substantial advantages in that an ample supply of anti-solvent material is produced in the coal liquefaction process and it is not necessary to recover a high percentage of the anti-solvent fraction from the coal liquid product, since the 400° F.+ product will normally be blended together for sale in any case. It was unexpectedly found that the anti-solvent liquid can have a Kauri-butanol number of at least about 40 and preferably between 50 and 150. The Kauri-butanol number is a known indicator of the aromaticity of a hydrocarbon material. The anti-solvent is fractionated such that it does not contain any significant amount of hydrocarbon material boiling below the melting temperature of the mixture. In this way, the hydrocarbon mixture can be maintained in the liquid or molten state without the use of elevated pressures and pressurized vessels.

The settler vessels used are preferably live bottom type tanks in which the precipitated material can be raked out periodically or continuously while the product is undergoing settling and purification over a period of a day or more, instead of a period of a few hours as for the conventional solvent precipitation process. Since the present process operates at substantially atmospheric pressure, the settler vessels can be made larger and less expensive than conventional pressurized settlers.

This invention can also be used as the only solids precipitation or settling step for coal-derived liquids, by adding to such liquids an anti-solvent liquid fraction having a boiling range of 400°–650° F. In such an arrangement, recovery of the anti-solvent material from the overflow product is not necessary for satisfactory solids removal.

The settler overflow product is available as a liquid which can be shipped and used directly. If the settler is operated at high temperature, the product can be cooled and shipped as a solid to be used as such or remelted for use. Alternativaly, the overflow liquid product can be stripped of its anti-solvent content and then shipped as a solid to be used or remelted. The underflow material from the settler will usually be vacuum stripped to remove all valuable oils. The resulting bottoms material containing solids can then be used as feed to a gasification or coking step. Alternatively, the bottoms material can be flaked for burning if the sulfur content is within acceptable environmental limits, or for disposal if the sulfur content is excessive.

This solids precipitation or settling process can be used either as a finishing step on the liquid product from a conventional solvent precipitation settling step, or it can be applied as the only solids precipitation step used in a coal liquefaction process.

DESCRIPTION OF PREFERRED EMBODIMENTS

Figure 1:
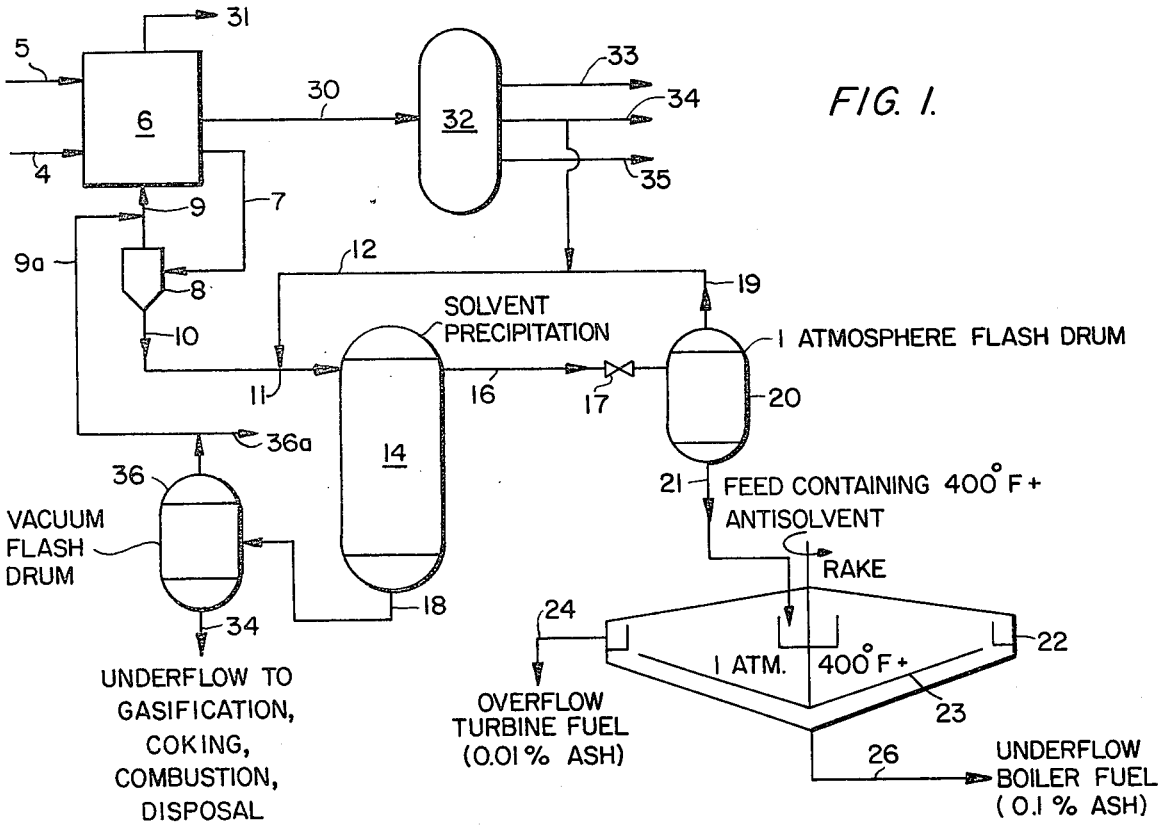
FIG. 1 is a schematic drawing of one embodiment of the invention showing a solids precipitation process wherein the overflow liquid from a pressurized anti-solvent precipitation step is flashed to atmospheric pressure and passed to a settler vessel for further precipitation of solids.

As illustrated by FIG. 1, bituminous or semi-bituminous coal at 4 and at 5 are introduced into a catalytic hydrogenation step 6 operated at elevated pressure and temperature conditions, such as disclosed by Ser. No. 956,533 filed Oct. 31, 1978, and which is incorporated herein by reference. A resulting coal-derived hyrodgenated liquid at 7 containing unconverted coal and ash solids not exceeding about 30 W % is introduced into a hydroclone separator 8, for liquid-solids separation, while a lighter solids-free liquid stream 30 preferably derived from an atmospheric distillation step within 6 (not shown) is passed to fractionation step 32 and a gas stream is withdrawn at 31. From fractionator 32, a light liquid stream 33 and intermediate boiling range liquid stream 34 are withdrawn. A heavy liquid product stream is withdrawn at 35.

From hydroclone 8, an overflow liquid stream 9 containing reduced solids concentration is recycled to the hydrogenation reaction step 6. Underflow stream 10 containing increased solids is mixed at 11 with a self-derived naphtha fraction 12, which is a portion of liquid stream 34. This naphtha fraction usually has a normal boiling range of 300°–550° F. and preferably is 350°–500° F. The resulting liquid mixture is fed to pressurized first settler vessel or precipitator 14. If the pressure in precipitator 14 is above that of streams 10 and 12, pumps (not shown) will be required in streams 10 and 12. It has been found that the ratio of anti-solvent liquid 12 to underflow liquid stream 10 should be between about 0.5 and 1.5 for good separation results. A holding tank (not shown) can be provided for anti-solvent liquid in line 12, if desired. Also, if desired, a special mixing tank (not shown) can be provided at point 11 to assure intimate mixing of the two liquids upstream of first settler vessel 14. The conditions in first settler 14 should be within the range of 50–200 psig pressure and 500°–600° F. temperature.

From vessel 14, a clarified overflow fraction containing reduced solids is removed at 16, and an underflow stream containing increased concentration of unconverted coal and ash is removed at 18. The overflow fraction 16 is passed to flashdrum 20, wherein the pressure is reduced at valve 17 to essentially atmospheric pressure. A light fraction stream is removed at 19 to recover a part of the 300°–550° F. naphtha fraction anti-solvent liquid needed, and it is combined with stream 12 for recycle to precipitation step 14.

The resulting underflow liquid portion 21 from flashdrum 20 is fed to second or low pressure settler 22 at a point near its center. This settler unit is maintained at a temperature sufficient to keep the bulk of the hydrocarbon material in liquid form, or usually at about 400°–500° F. temperature and at essentially atmospheric pressure. The precipitation of solids which was commenced in pressurized first settler 14 is continued in second settler 22, along with polymerization of asphaltenes for periods of time of at least about 8 hours and up to several days maximum duration.

Because of the further polymerization and settling of asphaltenes in second settler 22 while in a liquid condition, overflow product stream 24 contains less than about 0.02 W % ash, and preferably less than 0.01 W % ash, and is thereby suitable as a fuel for gas turbines or for boilers without flue gas precipitators. Underflow stream 26 will contain increased ash, usually about 0.1 W %, and is suitable for use as fuel for firing stream boilers with precipitators which can tolerate the higher concentration of impurities. If desired, an internal rotary rake device 23 can be used in settler 22 to facilitate removal of the heavy bottoms stream 26.

The underflow stream 18 from first settler vessel 14 will contain solids concentration of 36 to 60 W % by varying its withdrawal rate, and is passed to flash drum 30 operating at sub-atmospheric pressure. The resulting heavy liquid material containing up to about 60 W % solids is withdrawn at 37, and can be used as feed to a coking or gasification step. The overhead stream **36*a* is usually withdrawn as product, but if desired a portion 9*a* can be combined with liquid stream 9 being recycled to the coal hydrogenation reactor step 6** for further processing, such as coal slurrying oil.

Figure 2:
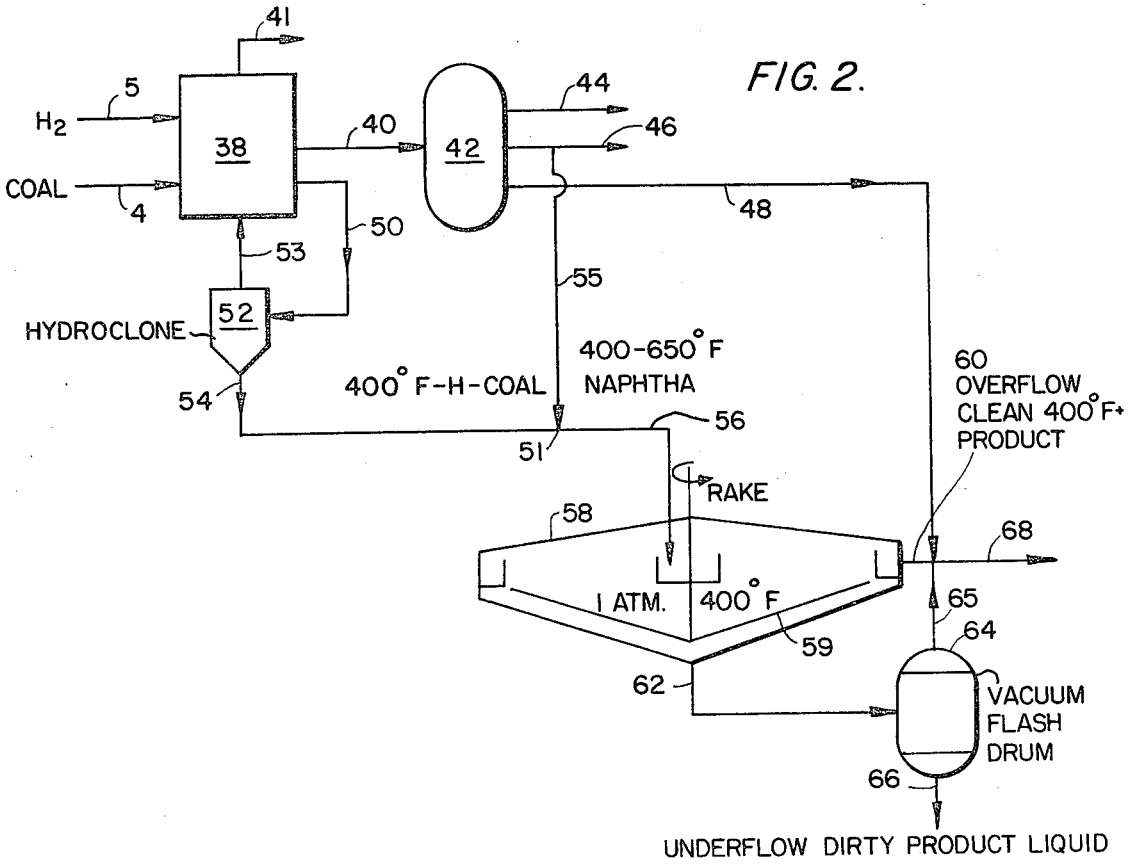
FIG. 2 shows an alternative embodiment wherein a precipitating anti-solvent liquid fraction is added to a coal-derived liquid and passed directly to a settler vessel at atmospheric pressure as the sole solids precipitation step.

An alternative embodiment is illustrated by FIG. 2, wherein a low pressure settler is used as the only solids precipitation-separation step in a coal hydrogenation liquefaction process. Coal at 4 and hydrogen at 5 are introduced into coal catalytic hydrogenation-liquefaction unit 38, similarly as in FIG. 1. From liquefaction process step 38, a gas stream is withdrawn at 41, and a light coal-derived liquid stream 40 is passed to fractionation step 42, from which various liquid fractions are withdrawn at 44, 46 and 48 as shown. Also from hydrogenation step 38, a heavy solids-containing liquid stream 50 is withdrawn and introduced into a hydroclone or centrifuge separator 52 for liquid-solids separation. The resulting hydroclone overflow stream 53 containing a reduced concentration of solids is recycled to the liquefaction reaction step 38.

Hydroclone underflow liquid stream 54 containing increased solids concentration is mixed at 51 with a 400° F.+ naphtha fraction anti-solvent liquid 55 derived from the process as a portion of stream 46 from fractionation step 42. The resulting liquid mixture 56 is passed to low pressure settler vessel 58. The 400° F.+ anti-solvent liquid 55 derived from the vapor product of coal hydrogenation by distillation at 42 usually comprises a 400°–650° F. boiling range material, and preferably has 400°–600° F. range.

The settler vessel 58 is maintained at atmospheric pressure and under liquid conditions at approximately 400° F. temperature, and the feed mixture 56 is introduced at near the center of the liquid surface. After sufficient residence time in the settler of at least about 8 hours and preferably 12–48 hours, asphaltenes and ash solids substantially settle to the bottom, and an overflow liquid stream containing low ash is withdrawn at 60 as product. The remaining underflow stream 62 containing increased concentrations of ash and insoluble material is withdrawn and passed to vacuum flash drum 64, from which the vacuum overhead vapor is recovered at 65 and is combined with clean overflow stream 60 to form product stream 68. Alternatively, a portion of stream 65 can be recycled with stream 53 to the coal hydrogenation unit 38. The remaining heavy liquid underflow stream containing solids is withdrawn at 66 and can be used for coking, combustion, or gasification.

This invention is further illustrated by reference to the following example, which should not be construed as limiting the scope of the invention.

EXAMPLE

It was observed that as hydroclone underflow or vacuum still bottoms materials derived from coal were maintained in the liquid state, they continued to polymerize and increase in viscosity. During the first observation of this phenomenon, the overflow product from a settler run on coal-derived liquid, which was originally unsatisfactory for fuel product with an ash contents of 3 to 6 W %, was retested after standing two weeks at ambient temperature and pressure conditions. The liquid in the upper portion of the barrel then has an ash content of 0.001 to 0.01 W %, indicating continued precipitation of solids to a low level and which would be satisfactory for turbine fuel.

It has earlier been observed that overflow liquid material prepared by another solvent precipitation process on reconstituted H-Coal® process vacuum bottoms material had separated into two liquid phases, each having appreciably different solids concentrations. Similar product was prepared using reconstituted coal-derived material and it was found that the upper phase of the mixture, constituting approximately 6% of the total, had an extremely low ash content of 11 ppm (0.0011 W %) thus making it gas turbine quality fuel even though the residual oil solids content was still relatively high at 14 W %. The sulfur and nitrogen concentrations in these liquid fractions were also low at 0.19 W % and 0.6 W %, respectively.

These data indicate that the anti-solvent precipitation action does not cease when the mixed coal-derived liquid overflow material leaves the settler vessel, but continues by polymerization of asphaltenes and precipitation of high molecular weight hydrocarbons and solids as long as the material is substantially molten. This precipitation action achieves further removal of ash solids and sulfur and nitrogen compounds from the overflow liquid fraction, thus making it suitable as fuel without further processing steps.

Although this invention has been described in detail with reference to certain embodiments thereof, it will be understood that variations and modifications in the process can be made within the spirit and scope of the invention as described hereinabove and as defined by the following claims.

I claim:

1. A liquid-solids separation process for removal of unconverted coal and ash particulate solids from hydrogenated coal-derived liquids by extended solvent precipitation and settling which process consists essentially of:

(a) adding to said coal-derived liquid one selected anti-solvent liquid naphtha fraction derived solely from the coal liquid without further hydrogenation and having a normal boiling range between about 300°–550° F.;

(b) mixing said two liquid streams together upstream of a first solids precipitation and settling step maintained at superatmospheric pressure and maintaining the mixture at sufficient temperature and settling time in the settling step to produce polymerization of asphaltenes and substantial precipitation and settling of the solids, so as to provide a clarified overflow liquid portion and an underflow liquid portion having increased solids concentration;

(c) withdrawing said overflow liquid portion containing substantially reduced concentration of solids and passing the stream to a second solvent precipitation step maintained at atmospheric pressure and at sufficient temperature to maintain a substantially liquid condition therein; and (d) withdrawing an overflow liquid product stream from said second precipitation step containing less than about 0.1 W % ash.

2. The process of claim 1, wherein at least a portion of said anti-solvent additive liquid in (a) is derived from said clarified overflow liquid portion, which is pressure-reduced to atmospheric pressure and phase separated, and the resulting overhead stream is recycled as part of the anti-solvent liquid added at (a).

3. The process of claim 1, wherein the first precipitation step conditions are maintained at 50–200 psig pressure and 500°–600° F. temperature.

4. The process of claim 1, wherein the additive anti-solvent liquid fraction is derived by fractionation from coal liquid streams and has a Kauri-butanal value between about 40 and 150.

5. The process of claim 1, wherein the ratio of the added anti-solvent liquid to coal derived liquid to provide the first settler feed liquid is between about 0.5 and 1.5, and the clarified overflow liquid portion contains 0.1 to 1.0 W % unconverted coal and ash solids.

6. The process of claim 1, wherein the solids concentration in the first settler underflow liquid is maintained between about 30 and 60 W % by varying its withdrawal rate, and the underflow liquid is pressure reduced and flashed to recover light fractions as an overhead product stream.

7. The process of claim 1, wherein the hydrogenated coal-derived liquid is passed through a centrifugal type liquid-solids separation step for partial removal of particulate solids upstream of step (a), and the centrifugal step underflow liquid stream is then passed to (a) for further removal of solids.

8. The process of claim 7, wherein the first settler overflow liquid stream is flashed at atmospheric pressure upstream of the second solids settling step to provide a portion of the anti-solvent liquid.

9. A liquid-solids separation process for removal of unconverted coal and ash particulate solids from hydrogenated coal-derived liquids by extended solvent precipitation, which process consists essentially of:

(a) adding to said coal-derived liquid one selected anti-solvent liquid naphtha fraction derived solely by distillation from the coal liquid without further hydrogenation and having a normal boiling range between about 300°–550° F.;

(b) mixing said two liquid streams together upstream of a first solids settling step and maintaining the mixture at 50–200 psig pressure and 500°–600° F. temperature and at sufficient settling time in said settling step to produce substantial polymerization of asphaltenes and precipitation and settling of the solids, so as to provide a clarified overflow liquid portion and an underflow liquid portion having increased solids concentration;

(c) passing said underflow liquid portion at reduced pressure to a phase separation step to recover a light fraction product stream;

(d) withdrawing said clarified overflow liquid portion containing a substantially reduced concentration of unreacted coal and ash solids and passing the liquid to a phase separation step at atmospheric pressure, and passing the resulting underflow liquid to a second solvent precipitation step at sufficient temperature to maintain a substantially liquid state and at atmospheric pressure;

(e) withdrawing an overflow liquid product stream from said second precipitation step containing less than about 0.1 W % ash; and (f) withdrawing an underflow liquid stream from said second settling step.

10. A liquid-solids separation process for removal of unconverted coal and ash particulate solids from hydrogenated coal-derived liquids by extended solvent precipitation and settling which process consists essential of:

(a) passing a hydrogenated coal-derived stream to a centrifugal type liquid-solids separation step to provide overflow and underflow liquid streams, and recycling the overflow stream to the hydrogenation step;

(b) adding to said separation step underflow liquid stream a selected naphtha anti-solvent liquid fraction derived solely from the coal-liquid without further hydrogenation and having a normal boiling range between about 400°–650° F.;

(c) passing the resulting liquid mixture to a solids settling step maintained at atmospheric pressure and at sufficient temperature to maintain the mixture in substantially liquid condition, and providing sufficient settling time therein to produce substantial polymerization of asphaltenes and precipitation of the solids, so as to provide a clarified overflow liquid portion and an underflow liquid portion containing increased solids concentration;

(d) withdrawing the clarified overflow liquid stream containing less than about 0.1 W % ash as liquid product; and (e) withdrawing the underflow liquid product stream.

11. The process of claim 10, wherein the anti-solvent additive liquid is derived by fractionation of a light coal-derived liquid stream.

12. The process of claim 10, wherein the solids settling step temperature in step (c) is in the range of 400°–600° F., and internal rake means is used for providing movement and preventing excessive settling of the bottoms stream.

13. The process of claim 10, wherein the additive anti-solvent liquid fraction is derived by fractionation from a coal liquid atream and has a Kauri-butanol value between about 40 and 150.

14. The process of claim 10, wherein the ratio of the added anti-solvent liquid to separator underflow liquid to provide the settler feed liquid is between about 0.5 and 1.5, the solids settling time in the settling step is at least 8 hours, and the settler overflow liquid product contains 0.1 to 1.0 W % unconverted coal and ash solids.

15. The process of claim 10, wherein the settler underflow liquid stream is flashed at sub-atmospheric pressure in a vacuum distillation step, from which an overhead stream is withdrawn as product and bottoms liquid stream is withdrawn.

16. The process of claim 10, wherein the liquid mixture passed to settling step (c) is introduced near the center of a settler vessel, and the clarified overflow liquid is withdrawn from near the periphery of said vessel.

* * * * *